US005695151A

United States Patent [19]

Schwandt et al.

[11] Patent Number: 5,695,151

[45] Date of Patent: Dec. 9, 1997

[54] PRINTING PRESS ASSEMBLY WITH POWERED PAPER ROLL LOADER

[75] Inventors: Charles W. Schwandt, Naperville; Mary Beth Fawcett, Medinah, both of Ill.; Bob LaBarre, Valparaiso, Ind.; Karen Klein, Orchard Park, N.Y.

[73] Assignee: Goss Graphic Systems, Inc., Westmont, Ill.

[21] Appl. No.: 999,627

[22] Filed: Dec. 31, 1992

[51] Int. Cl.[6] ..... B65H 19/12

[52] U.S. Cl. ..... 242/559.4

[58] Field of Search ..... 242/559.4, 559.3, 242/559.1, 598.3, 555.5; 414/911

[56] References Cited

U.S. PATENT DOCUMENTS

| | | | |
|---|---|---|---|
| 2,266,446 | 12/1941 | Sluyter | 242/559.4 X |
| 2,622,816 | 12/1952 | Koch | 242/559.4 |
| 3,015,454 | 1/1962 | Flannery et al. | 242/555.5 X |
| 3,073,539 | 1/1963 | Brown | 242/559.4 |
| 3,458,185 | 7/1969 | Merrill | 242/559.4 X |
| 4,026,486 | 5/1977 | Law | 242/559.4 X |
| 4,443,291 | 4/1984 | Reed | 242/559.4 X |
| 4,767,076 | 8/1988 | Tagawa | 242/559.3 X |
| 5,228,634 | 7/1993 | Jardis | 242/559.4 |

*Primary Examiner*—John M. Jillions
*Attorney, Agent, or Firm*—Potthast & Ring

[57] ABSTRACT

A printing press assembly (10) with a powered paper roll loader (22) having a triangular frame made of a pair of spaced upright triangular frame sections (28) supporting a pair of load chains (36A, 36B) to raise and lower a pair of load hooks (32) and associated eject hooks (34) that support opposite ends of a core axle (16) of a paper roll (18). The load chains are powered by an electric motor (54) and gear box (48) driving a pair of sprocket pulleys (38A, 38B) interconnected by a tie shaft (33) to insure movement in unison. The control from the motor (54) has a pair of "dead man" switches for optimal safety during operation, while the frame (28) is located beneath paper feed rollers (14) to reduce floor space utilization. The eject hook (34) is used to move the paper roll (18) from the operative position to underlying support by the load hook (32) to lower the paper roll (18) to the ground (17).

4 Claims, 4 Drawing Sheets

PRINTING PRESS ASSEMBLY WITH POWERED PAPER ROLL LOADER

BACKGROUND OF THE INVENTION

1. Field of the Invention

This invention relates generally to the field of printing press roller assemblies and more particularly to such printing press assemblies having a paper roll mounting apparatus.

2. Description of the Related Art Including Information Disclosed Under 37 CFR §1.97–1.99

Printing press roller assemblies having a plurality of inking and dampening rollers for printing paper sheets out from a large paper roll are well known. It is also known in such printing press assemblies to have an apparatus to elevate and mount the paper rolls onto a printing press assembly. The known paper roll mounting systems use a mechanical lever for manual lifting of the paper rolls. These known mechanical mounting systems have claws or hooks which latch onto the opposite ends of a core shaft which extends completely through and beyond the edges of the paper roll. The operator of the press places the ends of the core shaft on the hooks of the mechanical mounting system and pulls the lever to lift the paper roll into place on the printing press.

The printing press assemblies are used for producing hundreds and sometimes thousands of newspapers, magazines and other published articles each hour. Therefore, the size of the paper rolls used in such assemblies are typically forty inches in diameter and thirty-five inches wide. Depending on the type of paper stock used, each roll to be manually mounted on the press can weigh as much as fifteen hundred pounds. The lifting and placing of these extremely bulky and heavy paper rolls through use of the known manual mechanical systems places a tremendous amount of stress to the back of the operator. Additionally, the hand of the operator can be severely injured if the mechanical lever slips out of the operator's hand and gets caught between the paper roll and the side frame of the printer. Many operators of the known mechanical systems have been injured by having the paper rolls land on their feet because the roll was too heavy to lift manually.

Systems using driven hooks to elevate and lower elongate objects and which use chain drives are also known. However, these known mechanisms are not used for powered loading and unloading of paper rolls in a printing press roller assembly. Examples of such mechanisms are shown in U.S. Pat. No. 4,541,767 of Daberkow issued Sep. 17, 1985; Japanese patent 54-20578 of Tateishi Kenki K. K. and Hideharu Tsutsumi issued Feb. 16, 1979; German patent 2,246,132 of Kocks issued Sep. 20, 1972; Russian patent SU-617-340 of N. T. Zaitsev issued Jul. 5, 1978 and Russian patent SU-648-486 of G. A. Krapukhin issued Feb. 25, 1979.

Moreover, none of these mechanisms are well adapted to printing press applications. They are not easily employed in locations to minimize floor space utilization and provide no means for effectively unloading paper rolls and suffer from other disadvantages which make them unsuitable.

SUMMARY OF THE INVENTION

Thus, the principal object of the present invention is to provide a printing press assembly with a powered paper roll loading assembly, or loader, for loading a paper roll into an operative feed location where paper can be drawn from the roll, and more particularly, to such a printing press assembly in which the paper rolls are inherently maintained in a stable horizontal position during movement by the powered paper roll loader, the powered loader is mounted in a convenient location beneath the rollers for economy of floor space and to facilitate retrofitting, the powered operation is inherently safe, and the powered loader includes means to unload as well as to load paper rolls.

This object is achieved by providing a printing press assembly for printing on paper drawn from a paper roll with a powered paper roll loading assembly having a first upright support frame, a second support frame spaced from and substantially parallel to the first support frame, a pair of load chains supported opposite one another at the first and second support frames for movement along a load path, means mounted to the pair of load chains for carrying opposite ends of the paper roll and means for driving the pair of load chains to move in synchronism to simultaneously lift the opposite ends of the elongate paper rolls together in unison.

The object is further achieved by providing a printing press assembly for printing on paper drawn from a paper roll by at least one feed roller when the paper roll is in an operative location with a powered paper roll loading assembly having a frame located beneath the at least one roller, a drive chain assembly mounted to the frame, means connected to the drive chain assembly for supporting the paper roll and means located beneath the at least one roller for driving the chain assembly to move the supporting member and a paper roll supported thereby to the operative location.

The object of the invention is also achieved by providing a printing press assembly for printing on paper drawn from a paper roll when in an operative location with a powered paper roll loading assembly having a support frame, a chain assembly connected to the support frame for moving the paper roll to the operative location, means for driving the chain assembly to move, a manual operator switch for activation of the driving means and means for activating the driving means only so long as the manual operator switch is manually held in an on position.

Moreover, the object of the present invention is achieved by providing a printing press assembly for printing on paper drawn from a paper roll with a powered paper roll loading assembly having a triangular frame with a pair of legs which meet at a peak, a pair of carrying members for holding a paper roll therebetween, means for mounting the pair of carrying members for movement on a path along the legs and over the peak and means for driving a pair of members along the path to selectively load and unload a paper roll supported by said carrying members.

BRIEF DESCRIPTION OF THE DRAWING

The foregoing objects and advantageous features of the invention will be explained in greater detail and others will be made apparent from the detailed descriptio of the preferred embodiment of the present invention which is given with reference to the several figures of the drawing, in which.

DESCRIPTION OF THE PREFERRED EMBODIMENT

Figure 1:
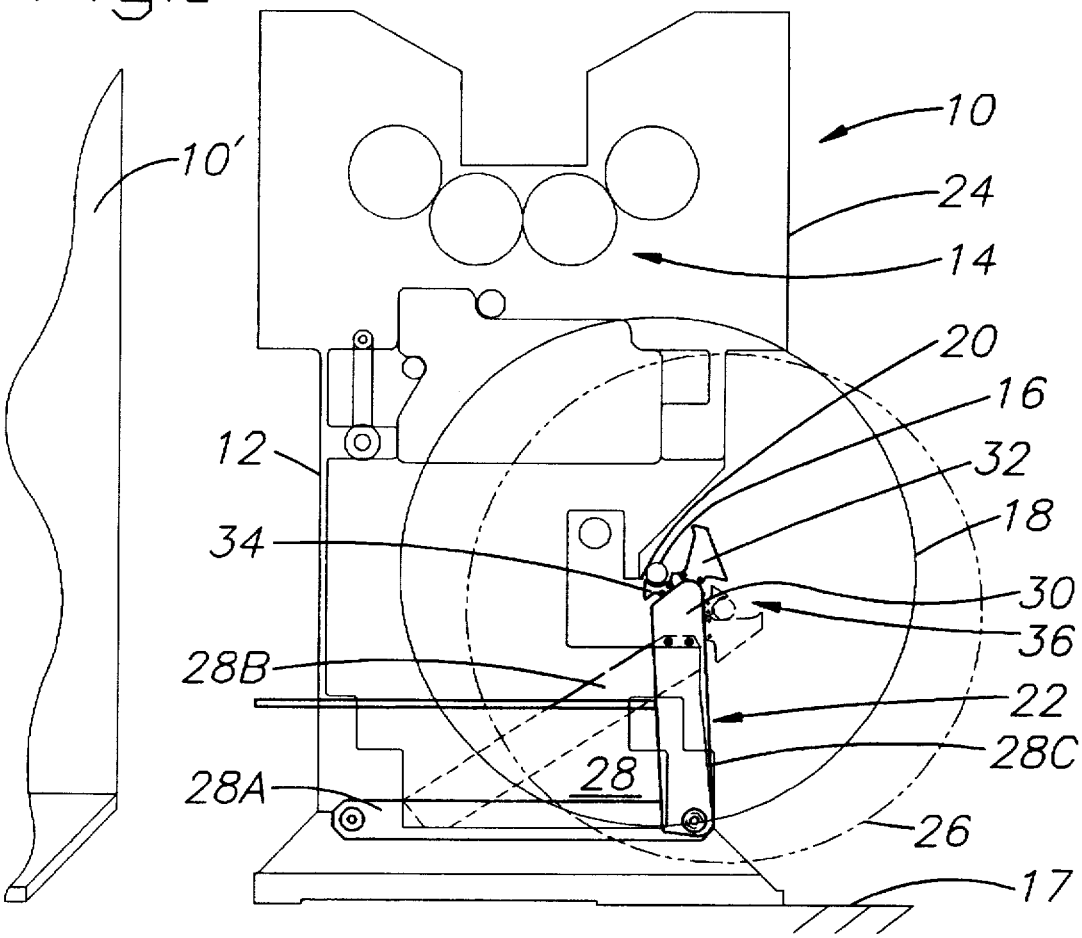
FIG. 1 is a side view of a preferred embodiment of the printing press assembly with the powered paper roll loader of the present invention illustrating the operative and non-operative positions between which the powered loader moves the paper roll.

Referring to FIG. 1, the printing press assembly 10 of the present invention is seen to include a frame 12 which supports a plurality of paper feed rollers 14 in a relatively elevated position and a core axle 16 of a paper roll 18 at an operative location from which paper is drawn from the paper roll 18. The core axle 16 passes through the center of the paper roll 16 and is supported adjacent an upwardly facing arcuate axle support 20 by a pair of drive rollers shown in FIG. 2. The core axle 16 protrudes from opposite ends of the paper roll 18 and is supported on axle supports 20 on opposite sides of the press, but since FIG. 1 is a side view, only one side is shown. The printing press assembly 10 is generally symmetrical relative to a transverse plane passing through the center of the plurality of paper feed rollers 14.

When suspended by its core axle 16 by opposed axle supports, an end of the paper roll is fed through the paper feed rollers 14 and then moves downstream to the portion 10' of the printing press assembly at which printing presses operate to print information on the paper with rollers and cuts the paper into sheets and pages. The details of the printing operation performed by the portion 10' of the printing press assembly 10 form no part of the present invention and therefore are not shown, but reference can be made to U.S. Pat. No. 5,107,762 issued Apr. 28, 1992 to Fadner et al. and patents cited therein, if such details are desired.

Figure 2A:
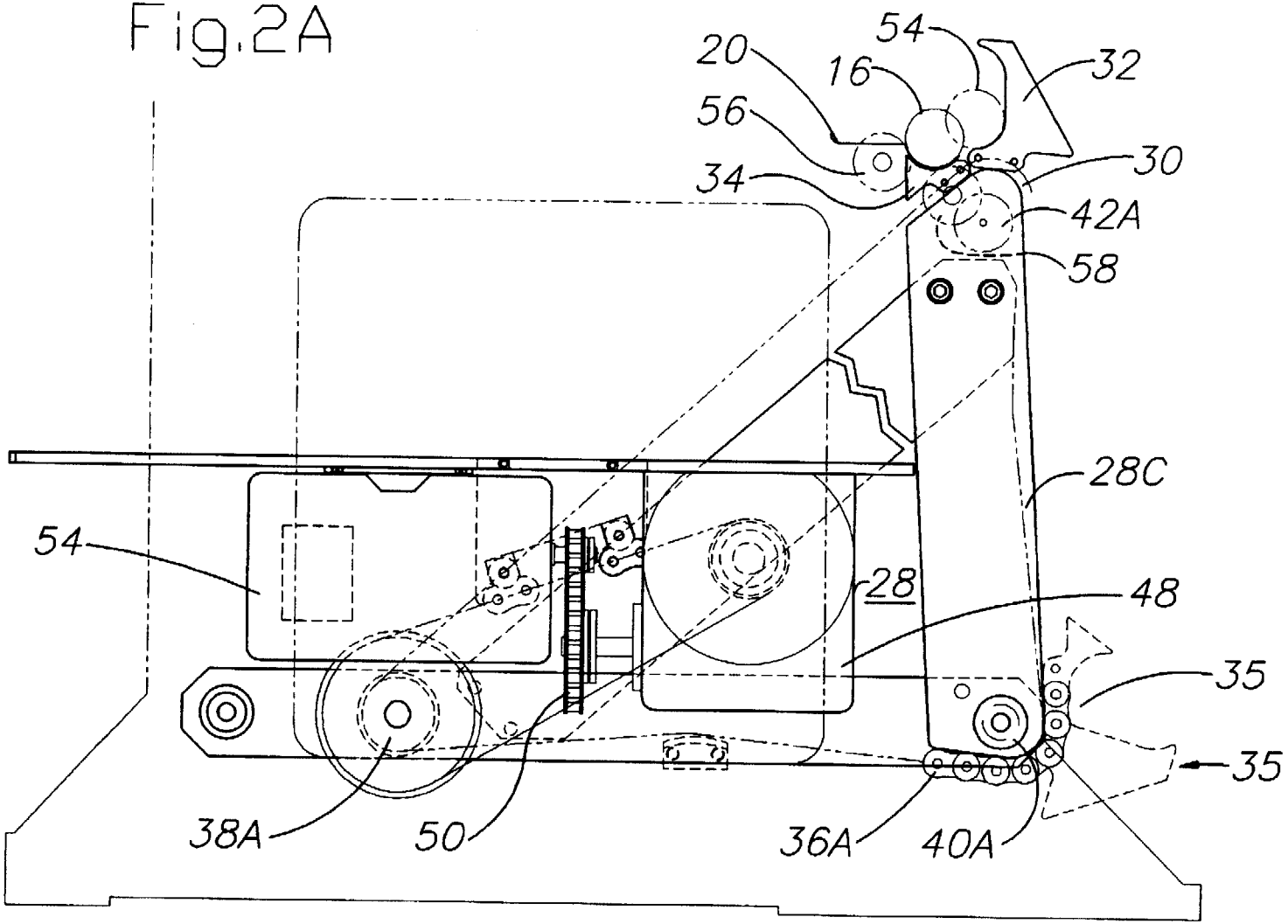
FIGS. 2A and 2B are enlarged side and plan views of the power loader of FIG. 1 to illustrate in greater detail the preferred form of the paper roll.

All that is needed to be known relative to the invention is that once the paper roll is mounted into the operative location with its core axle 16 as shown in FIG. 2A the end of the paper roll is passed between the nibs of the plurality of paper feed rollers 14 and paper is drawn off the paper roll as needed by the press until it is depleted. The core axle 16 of the depleted paper roll 18 must then be removed and a new paper roll 18 moved into the operative location. If an incorrect roll of paper 18 of the wrong type or size is loaded inadvertently, it must be unloaded before the correct paper roll 18 can be put in its place. As noted above, the present invention is concerned with apparatus for not only loading the paper roll into the operative location, but also for unloading an incorrect paper roll.

Still referring to FIG. 1, the principal feature of the printing press assembly 10 is the powered paper roll loading assembly, or loader, 22 which function to load and unload paper rolls 18 to and from the operative location. Obtaining one of the advantages of the invention, the loader 22 is spaced inwardly from the end 24 of the printing press assembly 10. This avoids blocking the floor space adjacent the end 24 which is needed to move the paper roll into a loading position 26 adjacent the end 24 of the printing press assembly 10, as shown in broken line, maintain an aisle between the printing press assemblies 10 and other printing press assemblies or other equipment. A loader which protrudes into the aisle is not acceptable, and thus has been avoided by advantageously locating the entire loader 22 in a space beneath the paper feed rollers 14 and recessed from the end 24 of the printing press assembly.

This is achieved in part by providing the powered loader with a triangular frame assembled from a pair of spaced, parallel upright triangular frame sections (only one shown). Each frame section 28 has a horizontal leg 28A extending inwardly from adjacent end 24 and a diagonal leg 28B extending from the distal end of the horizontal leg 28A to join the upper end of a substantially vertical leg 28C to form a peak 30 adjacent axle support 20. Leg 28C rises from a juncture with another end of the horizontal leg 28A. Each of the two triangular frame sections 28 carry a pair of movably mounted support members in the form of a load hook 32 and an oppositely facing unload, or eject, hook 34.

The protruding end of the core axle 16 is located between two hooks 32 and 34 during operation. In order to load a paper roll 18, it is first rolled to the load position 26 with hook 32 beneath the core axle 16 and the core axle 16 beneath the eject hook 34, as shown in broken line at 36. Both hooks 32 and 34 are then raised together over the peak 30 and then down the diagonal leg 28B until the axle 16 rolls from the load hook 32 to the eject hook 34 and lowered to the operative location. When at the operative location, the eject hook 34 is located beneath the core axle 16 and the load hook 32 is at the peak 30 and facing generally horizontally.

In order to eject an axle core 16 of a paper roll 18, the opposite movement of the hooks 32 and 34 takes place. The eject hook 34 moves up the diagonal leg 28B to lift the core axle 16 over the peak 30 which then rolls onto the load hook 32. The load hook 32 then is moved down the leg 28C until the paper roll 18 is resting on the floor.

Figure 2B:
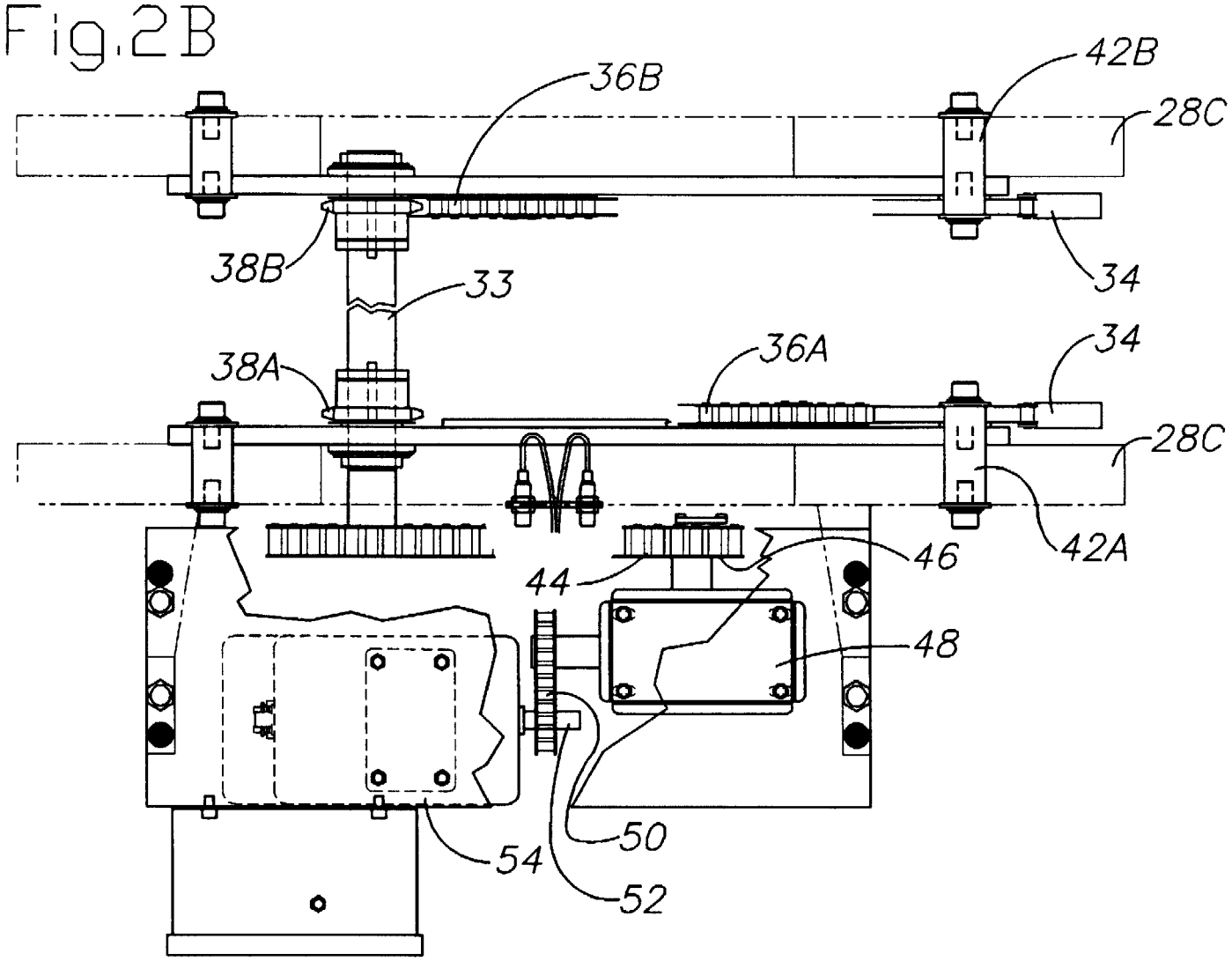

Referring now to FIGS. 2A and 2B, a pair of load chains 36A and 36B are respectively mounted to the ends of the triangular frame sections 28 to move along a generally triangular load path defined by drive sprockets 38A and 38B, pulleys 40A and 40B and pulleys 42A and 42B adjacent the peak 30. The drive sprocket 38A is connected through a drive chain 44 to an output sprocket 46 of a set of reduction gears in a gear box 48. The gears in the gear box 48, in turn, are driven by means of a drive chain 50 connected to the output shaft 52 of a reversible electrical motor 54. Electrical power to the motor 54 is controlled by manually actuatable up and down switches 50 and 52, described below with reference to FIG. 3. Switches 50 and 52 respectively cause the load chains 36A and 36B to respectively move along the load path in a counter clockwise and a clockwise direction, respectively, as viewed from the side shown in FIG. 2A.

In order to load a paper roll 16, the manual up and down switches are selectively actuated to move the load hook 32 and eject hook 34 along leg 28C to align the space 35 between the load hooks and the eject hook 34 with the height of the core axle 16 when resting on the floor 17. The paper roll 16 is then rolled or otherwise moved to the load position 26 at which the opposed ends of the core axle are respectively received within the space 35 with load hook 32 underlying the core axle 16. The up button 50 is then held in an actuated or closed state until the load hook has been raised to the peak 30, as shown in FIG. 2A. At this point, the core axle 16 rolls from the position shown in broken lines to the operative location supported for rotation by a pair of drive rollers 56 and 58.

A proximity sensor 60 detects when the load hook is at the peak 30, as shown, and shuts off the motor to prevent overtravel if the operator has not done so already. Likewise, when the load hook 32 and eject hook reach the lowest position at the bottom end of leg 28C, another proximity sensor 62 is automatically actuated to terminate power to the motor 54. When it is desired to unload a paper roll 16, the down switch 52 is actuated to raise the eject hook up leg 28B and over the peak 30 to cause the core axle 16 to roll from a position of underlying support by the eject hook 34 to underlying support by the load hook 32 as shown in broken line at 36, FIG. 1.

Referring still to FIG. 2B, obtainment of one of the objectives of the invention is obtained through provision of a tie shaft 33 which interconnects the drive sprockets 38A and 38B to insure that the load chains 36A and 36B move in synchronization to simultaneously move the two pair of load hooks 32 and 34 in unison. In this way, the two ends of the core axle 16 are lifted in unison to prevent tipping of the paper roll 18 relative to horizontal.

Figure 3:
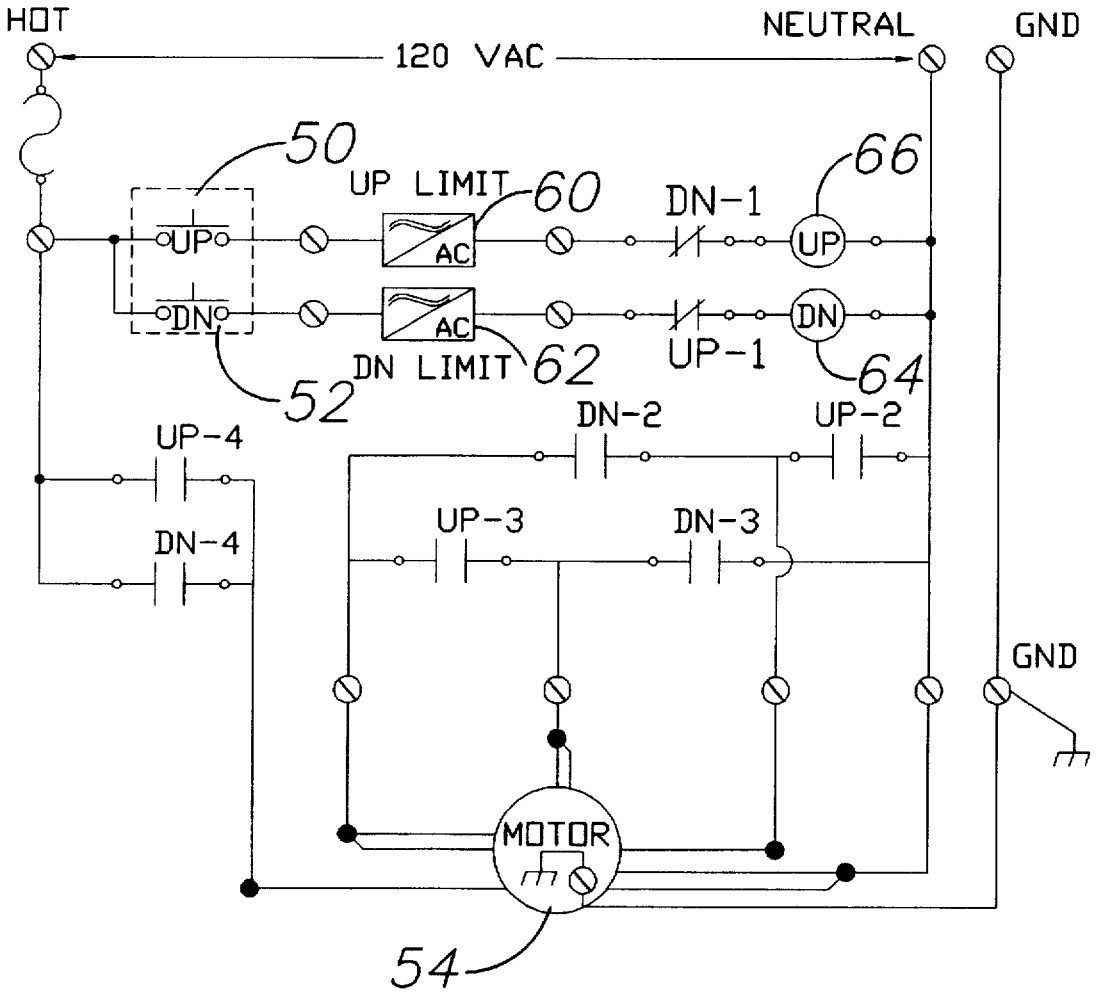
FIG. 3 is a schematic wiring diagram of the safety electrical controller of the powered paper roll loader.

Referring now to FIG. 3, in achieving another objective of the invention the up switch 50 and down switch are both "dead man" switches which require continuously manual actuation to maintain them in a closed position to optimize safe operation. When the up switch 50 is actuated, or closed, power is applied through the up limit proximity sensor 60, unless actuated to an open circuit condition, and a manually closed relay contact DN-1 of the down relay core 64 to an up relay coil 66. When up relay coil 66 is energized, an UP-1 relay contact is opened to prevent energization of the down relay 64 in response to closure of the down switch 52. Likewise, when the down relay coil 64 is energized, the relay contact DN-1 is opened to prevent energization of the up relay coil 66 in response to actuation of the up switch 52. Otherwise, actuation of down switch 52 will pass power through the down limit proximity sensor 62, unless actuated to an open circuit condition, to energize down relay coil 64.

When up relay coil 66 is energized, relay contacts UP-2, UP-3 and UP-4 are closed to cause the motor 54 to turn in a first direction to move the load hook 32 and eject hook 34 toward the upper limit shown in FIG. 2A.

Likewise, when the down relay coil 64 is energized, and the up relay coil 66 is de-energized, relay contacts DN-2, DN-3 and DN-4 are closed to reverse the polarity of the AC power applied to the motor 54 and thereby reverse the direction of rotation. This causes the load chain to travel in an opposite direction to move the load hook 32 and the eject hook 34 toward the lower limit portion shown in broken lines at 37 in FIG. 2A.

While a detailed description of the preferred embodiment of the invention has been given, it should be appreciated that many variations can be made thereto without departing from the scope of the invention as set forth in the appended claims.

We claim:

1. In a printing press assembly having a printing press for printing on paper drawn from a paper roll by at least one feed roller when the paper roll is at an operative location, the improvement being a powered paper roll loading assembly, comprising:

a frame located beneath at least one roller in which the frame has a triangular shape with a pair of legs extending adjacent an end of the printing press at the operative location to beneath the printing press and in which the frame has a generally vertical third leg located adjacent the operative location;

a drive chain assembly mounted to the frame;

means connected to the drive chain assembly for supporting the paper roll; and means located beneath the at least one roller for driving the chain assembly to move the supporting means and a paper roll supported thereby to the operative location adjacent the end of the printing press.

2. The printing press assembly of claim 1 in which said driving means includes a pair of chain sprockets adjacent opposite sides of the printing press, a tie shaft extending beneath the printing press to interconnect the pair of sprockets, and means beneath the printing press for driving the tie shaft and the sprockets connected therewith to rotate.

3. The printing press assembly of claim 1 in which the frame has a peak adjacent the operative location and a pair of legs joined to each other at the peak, and the supporting means includes means for supporting the paper roll on either side of the peak.

4. The printing press assembly of claim 3 in which the supporting means includes a pair of oppositely facing hooks.

* * * * *